US005716232A

United States Patent [19]

Endo et al.

[11] Patent Number: 5,716,232

[45] Date of Patent: Feb. 10, 1998

[54] FEMALE TERMINAL FOR CONNECTOR

[75] Inventors: Takayoshi Endo; Takashi Ishii, both of Shizuoka, Japan

[73] Assignee: Yazaki Corporation, Tokyo, Japan

[21] Appl. No.: 459,799

[22] Filed: Jun. 2, 1995

[30] Foreign Application Priority Data

Jun. 6, 1994 [JP] Japan ..... 6-123538

[51] Int. Cl.[6] ..... H01R 13/432

[52] U.S. Cl. ..... 439/595; 439/752.5; 439/851

[58] Field of Search ..... 439/851, 861, 439/862, 752.5, 595

[56] References Cited

U.S. PATENT DOCUMENTS

| | | | |
|---|---|---|---|
| 3,963,302 | 6/1976 | Gourley | 439/851 X |
| 4,298,242 | 11/1981 | McKee | 439/851 X |
| 4,529,260 | 7/1985 | Smith | 439/851 X |
| 4,874,338 | 10/1989 | Bakermans | 439/851 |
| 5,187,862 | 2/1993 | Ohsumi | 439/595 X |
| 5,205,763 | 4/1993 | Watanabe et al. | 439/595 X |
| 5,360,356 | 11/1994 | May et al. | 439/851 X |
| 5,556,304 | 9/1996 | Jinno | 439/595 |

FOREIGN PATENT DOCUMENTS

| | | |
|---|---|---|
| 55-17267 | 2/1980 | Japan . |
| 63-160677 | 10/1988 | Japan . |
| 64-16075 | 1/1989 | Japan . |
| 3-93176 | 4/1991 | Japan . |

*Primary Examiner*—Allan N. Shoap
*Assistant Examiner*—Christopher J. McDonald
*Attorney, Agent, or Firm*—Morgan, Lewis & Bockius LLP

[57] ABSTRACT

A female terminal which enables a tab of a male terminal to be fitted into a female terminal even if the tab is bent when a connector housing receiving the male terminal is fitted relative to a connector housing receiving the female terminal. An elastic engagement arm is provided within a terminal receiving chamber in a connector housing. A female terminal includes a fitting portion for receiving a male terminal, an engagement portion for being retained by the engagement arm, and a wire connection portion. A guide projection is formed on the fitting portion of the female terminal, the guide projection projecting forwardly beyond the front end surface of the female terminal. There is provided a slanting guide surface extending from the guide projection 18 to an inlet of the fitting portion. A groove for allowing the passage of the guide projection therethrough is formed in the engagement arm.

12 Claims, 5 Drawing Sheets

FEMALE TERMINAL FOR CONNECTOR

BACKGROUND OF THE INVENTION

This invention relates to a female terminal which is received in a connector housing, and is connected to a male terminal received in another connector housing when the two connector housings are fitted together.

FIG. 8 is a perspective view of a conventional female terminal A formed of a sheet material by pressing. At a front portion of this female terminal, opposite sides of a front portion (left portion in FIG. 8) of a base plate portion 1 serving as a bottom wall, and upper walls 3 extend respectively from upper ends of the opposite side walls 2 toward each other, and butt at each other, thereby forming a box-like fitting portion 4.

FIG. 10 is a perspective view of a conventional male terminal B which can be resiliently held between opposed inner surfaces of the fitting portion 4, a projection 5 is formed on one of these inner surfaces, and also projections 6 are formed on the other inner surface.

With this arrangement, the male terminal B inserted into the fitting portion 4 is resiliently held between projections 5 and 6.

A wire connection portion 7, formed at a rear portion (right portion in FIG. 8) of the base plate portion 1, has conductor clamping portions 8 and sheath clamping portions 9, the conductor clamping portions 8 as well as the sheath clamping portions 9 extending upwardly respectively from the opposite sides of the base plate portion.

A conductor of a wire is compressively clamped by the conductor clamping portions 8, and a sheath of the wire is compressively clamped by the sheath clamping portions 9.

A conventional male connector housing C (see FIGS. 9 and 10) for receiving the female terminal A has a terminal receiving chamber 10 having opposite open ends, and an elastic engagement arm 11 projects from an inner surface of the terminal receiving chamber 10.

The engagement arm 11 is slanting toward the front side (left side in FIG. 10) of the terminal receiving chamber 10, and has an engagement step 12 formed at the front end thereof.

When the female terminal A, having the wire W connected thereto, is inserted into the terminal receiving chamber 10 through the rear open end thereof, the fitting portion 4 is brought into engagement with the engagement arm 11 to elastically deform the same. When the fitting portion 4 passes past the engagement arm 11, the engagement step 12 of the engagement arm 11 is held against an engagement portion 13 defined by the edge of the upper wall of the fitting portion 4, thereby retaining the female terminal A (see FIG. 10).

The male terminal B, which has a plate-like tab 15 formed at its front end, and has a wire connected to its rear end, is inserted into a terminal receiving chamber 14 in a female connector housing D, and is retained by an engagement arm 16 formed within the terminal receiving chamber 14 (see FIG. 10).

When the male connector housing C is fitted into the female connector housing D, the tab 15 of the male terminal B is fitted into the fitting portion 4 of the female terminal A, thereby connecting the two terminals A and B together.

The male connector housing C is injection-molded of a synthetic resin, using a mold. In order to provide the engagement arm 11 in the terminal receiving chamber 10, it is necessary to form a space 17 at the front side of the terminal receiving chamber 10 (see FIGS. 9 and 10).

The tab 15 is in the form of a plate, and therefore may be bent upon engagement with some external object. Such bent or deformed tab 15 cannot be fitted into the fitting portion 4, but is received in the space 17, thus causing an incomplete connection (see FIG. 10).

When the connector housings C and D are fitted together, the tab cannot be easily seen, and therefore it is difficult to detect the incompletely-connected condition of the tab 15. Even when an electrical conduction test is carried out, such incomplete connection can not be found out if the tab 15 happens to be in contact with the upper surface of the fitting portion 4.

The present invention has been made in order to overcome the above problems, and an object of the invention is to provide a female terminal which positively enables the tab 15 to be fitted into the fitting portion 4 even if the tab is bent.

SUMMARY OF THE INVENTION

The above object has been achieved by a female terminal of the invention for a connector which is insertable into a terminal receiving chamber in a connector housing, and includes an engagement portion for being retainingly held against an elastic engagement arm provided in the terminal receiving chamber, a base plate portion for being held against that surface of the terminal receiving chamber disposed opposite to that surface of the terminal receiving chamber from which the engagement arm projects, a wire connection portion formed at a rear end thereof, and a fitting portion formed at a front end thereof; wherein a guide projection is formed on that surface of the fitting portion facing away from the base plate portion, the guide projection projecting forwardly beyond a front end surface of the female terminal; and there is provided a slanting guide surface extending from the guide projection to an inlet of the fitting portion.

Preferably, a groove is formed in the engagement arm for avoiding the interference of the engagement arm with the guide projection when inserting the female terminal into the terminal receiving chamber.

The groove is formed in at least one of the guide groove and the engagement arm, and with this construction, when the connector female terminal of the above construction is inserted into the terminal receiving chamber in the connector housing, the interference between the guide projection and the engagement arm is prevented.

When the fitting portion of the female terminal passes past the engagement arm, the engagement portion of the female terminal is retained by the engagement arm.

When a connector housing receiving a male terminal is fitted relative to the connector housing receiving the female terminal, a tab of the male terminal is fitted into the female terminal.

If the tab of the male terminal is in a bent condition, the tab strikes against the guide projection, and is guided by the slanting guide surface to be fitted into the fitting portion.

DESCRIPTION OF THE PREFERRED EMBODIMENTS

Figure 1A:
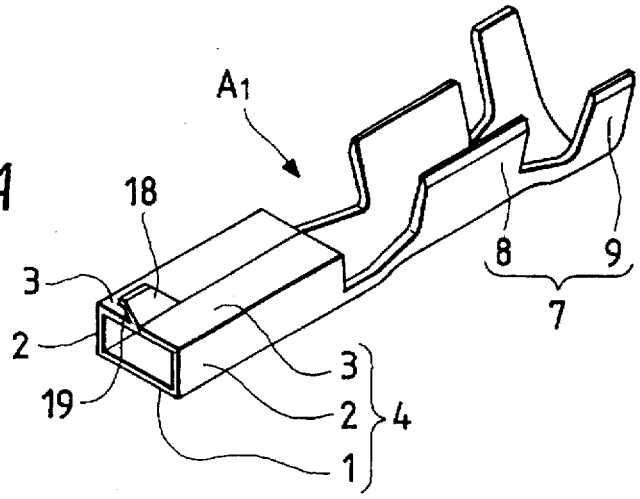
FIG. 1A is a perspective view of a first embodiment of a female terminal of the invention.
Figure 1B:
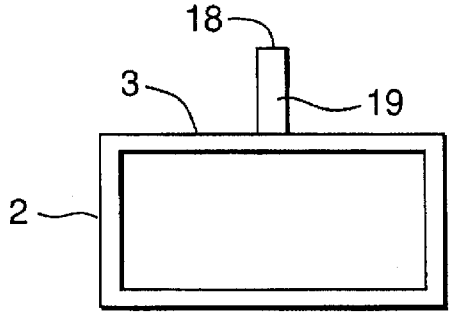
FIG. 1B is a front view of the first embodiment looking into the fitting portion.
Figure 1C:
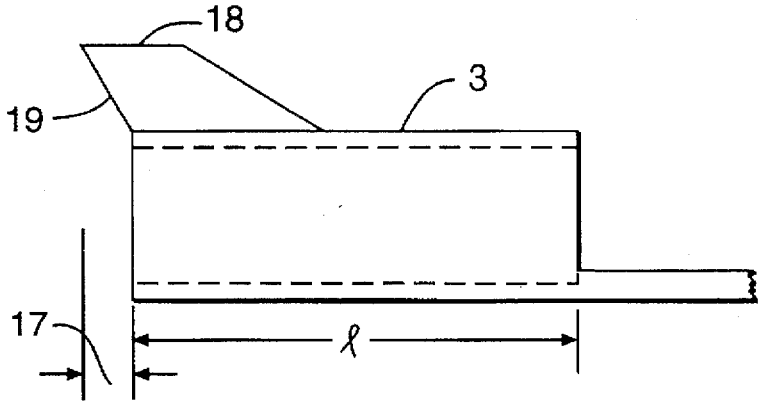
FIG. 1C is a side view of the first embodiment.
Figure 8:
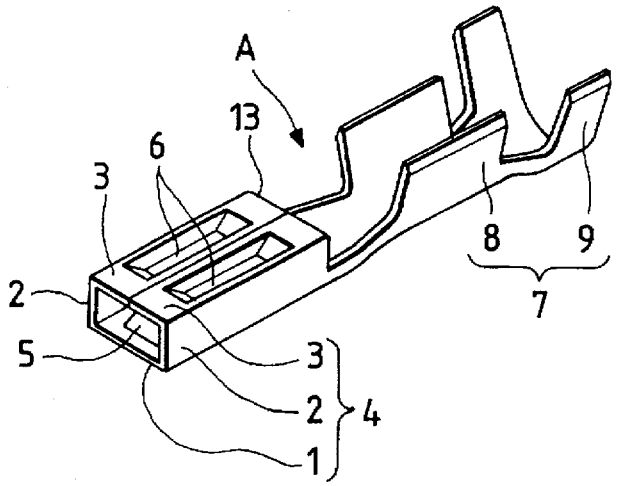
FIG. 8 PRIOR ART
FIG. 8 is a perspective view of a conventional female terminal.
Figure 9:
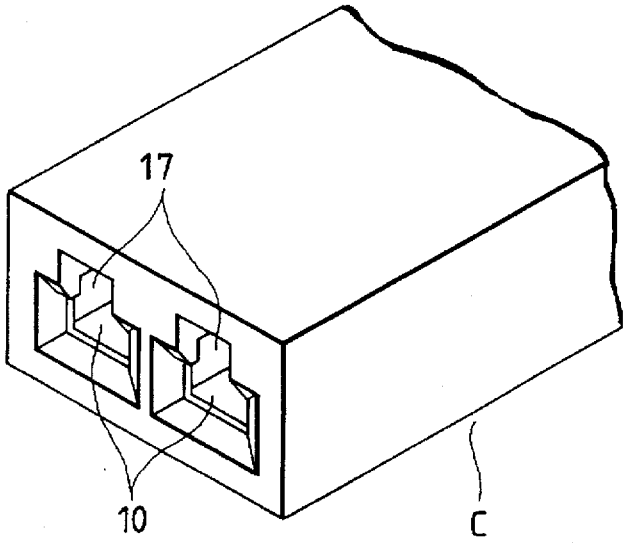
FIG. 9 PRIOR ART
FIG. 9 is a perspective view of an important portion of a conventional connector housing.
Figure 10:
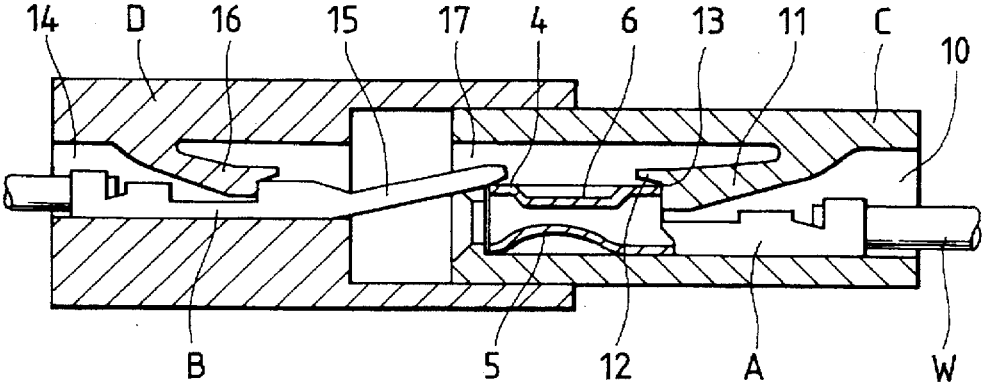
FIG. 10 PRIOR ART
FIG. 10 is a vertical cross-sectional view, of a conventional male and female housing showing an incomplete connection between the terminals.

A preferred embodiment of the present invention will now be described with reference to the drawings. FIGS. 1A–1C are a perspective, front, and side views respectively, view of a first embodiment of a connector female terminal $A_1$ of the invention which differs from the conventional connector female terminal A (See FIG. 8) in that a guide projection 18 is formed on that surface of a fitting portion 4 facing away from a base plate portion 1, and the right portion of $A_1$ is constructed the same as the conventional connector female terminal A.

The guide projection 18 extends obliquely from an end of one of upper walls 3 of the fitting portion 4, and therefore this guide projection 18 is disposed generally centrally of the width of the upper surface of the fitting portion 4.

An upper end of a front surface of the guide projection 18 is projected forwardly of the front end of the fitting portion 4, and there is provided a slanting guide surface 19 extending from the upper end of the front surface of the guide projection 18 to the inlet of the fitting portion 4 (see FIGS. 1A–1C).

Figure 11:
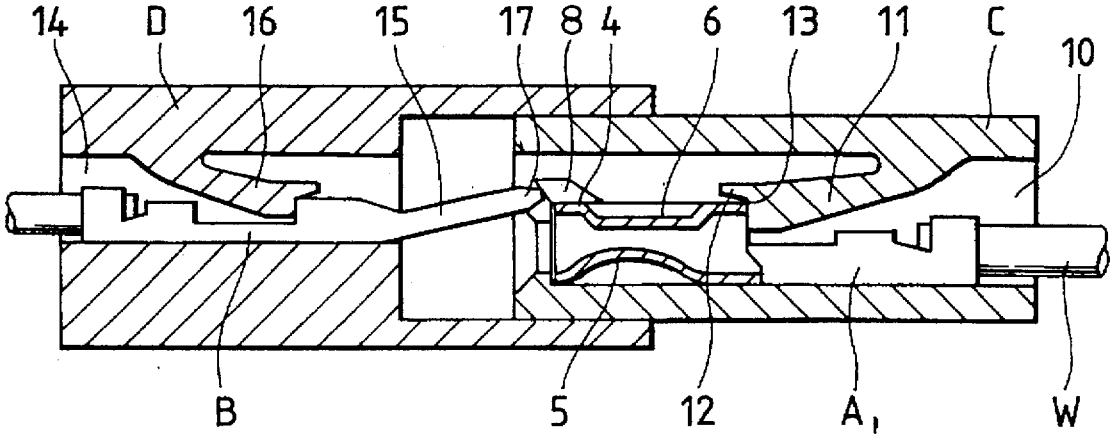
FIG. 11 is a vertical cross-sectional view of the invention showing an incomplete connection between the terminals of the male and female housings.

The guide projection 18 projects upwardly beyond the upper walls 3, and therefore when the female terminal $A_1$ is inserted into a terminal receiving chamber 10 in a connector housing C, an elastically-deformed engagement arm 11 allows the fitting portion 4 to pass past it, but hardly allows the guide projection 18 to pass past it (see FIG. 11).

Figure 4:
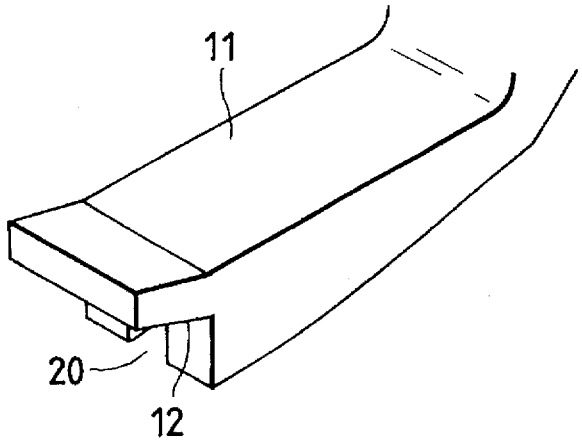
FIG. 4 is a perspective view of an engagement arm having a groove for the purpose of avoiding the interference with the first embodiment of the female terminal.
Figure 5:
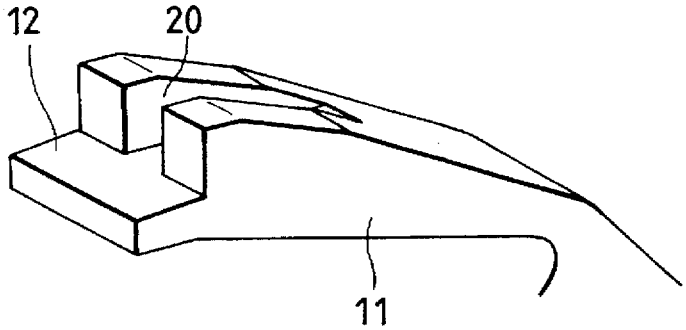
FIG. 5 is a perspective view of the engagement arm of FIG. 4 as viewed obliquely from the lower side.

Therefore, in order to avoid the interference of the engagement arm 11 with the guide projection 18, a groove 20 is formed in the engagement arm 11 for allowing the passage of the guide projection 18 therethrough (see FIGS. 4 and 5).

Figure 2A:
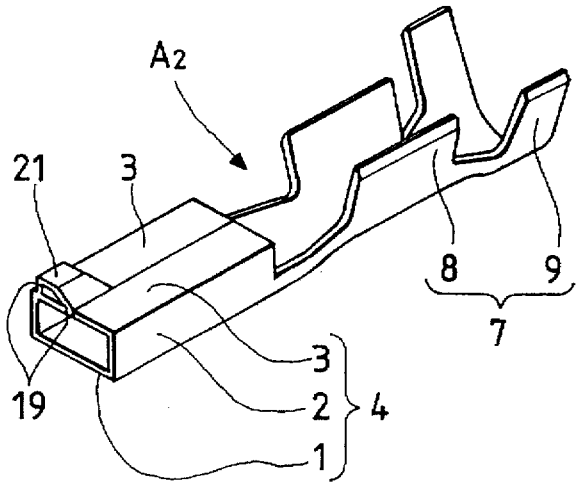
FIG. 2A is a perspective view of a second embodiment of a female terminal of the invention.
Figure 2B:
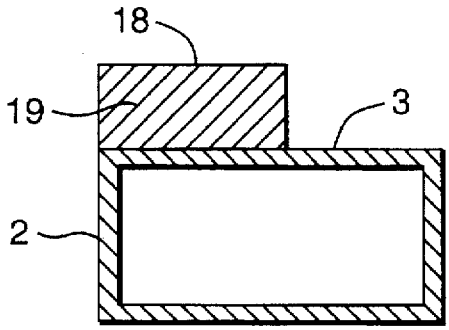
FIG. 2B is a front view of the second embodiment looking into the fitting portion.
Figure 2C:
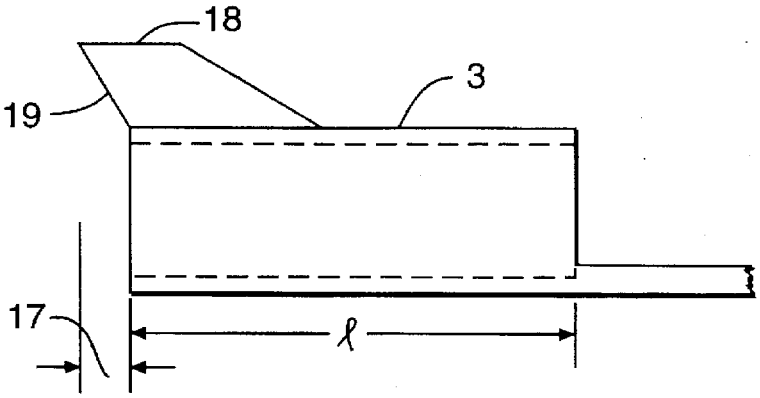
FIG. 2C is a side view of the second embodiment.

FIGS. 2A–2C are perspective, front, and side views respectively, view of a second embodiment of a connector female terminal $A_2$ of the invention. A guide projection 21 extends upwardly from an end of one upper wall 3, and then is bent perpendicularly, and then is bent downwardly to be contacted at its distal end with the upper wall 3.

Thus, the guide projection 21 is offset widthwise of a fitting portion 4, and two slanting guide surfaces 19 are formed on the front side of the guide projection.

In order to avoid the interference of the guide projection 21 with an engagement arm 11, a groove 22 is formed in the engagement arm 11 for allowing the passage of the guide projection 21 therethrough.

Figure 6:
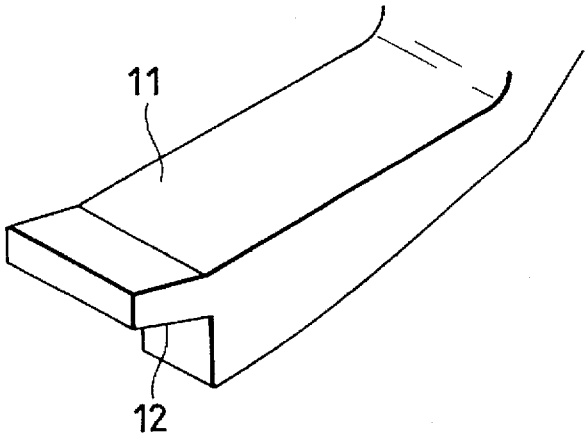
FIG. 6 is a perspective view of an engagement arm having a groove for the purpose of avoiding the interference with the second embodiment of the female terminal.
Figure 7:
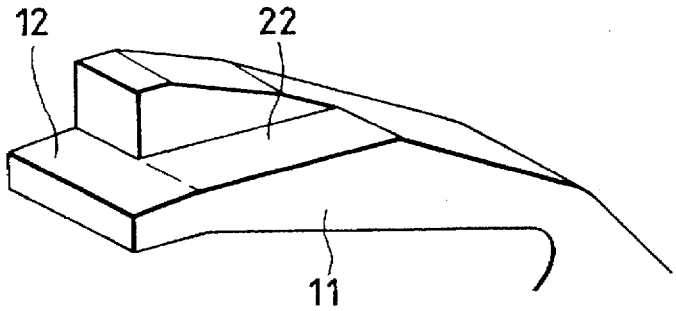
FIG. 7 is a perspective view of the engagement arm of FIG. 6 as viewed obliquely from the lower side.

The guide projection 21 is offset widthwise of the fitting portion, and therefore the groove 22 is also offset widthwise of the engagement arm 11 (see FIGS. 6 and 7).

The operation of the connector female terminal $A_1$ will now be described.

When the female terminal $A_1$ is inserted into the terminal receiving chamber 10 from the rear end of the connector housing C, the guide projection 18 first engages the engagement arm 11 to elastically deform the same, and then the guide projection 18 passes through the groove 20, and also the fitting portion 4 passes past the engagement arm 11 (see FIG. 11).

When the fitting portion 4 passes past the engagement arm 11, the engagement arm 11 is elastically restored, so that an engagement step 12 is retainingly held against an engagement portion 13.

Figure 3:
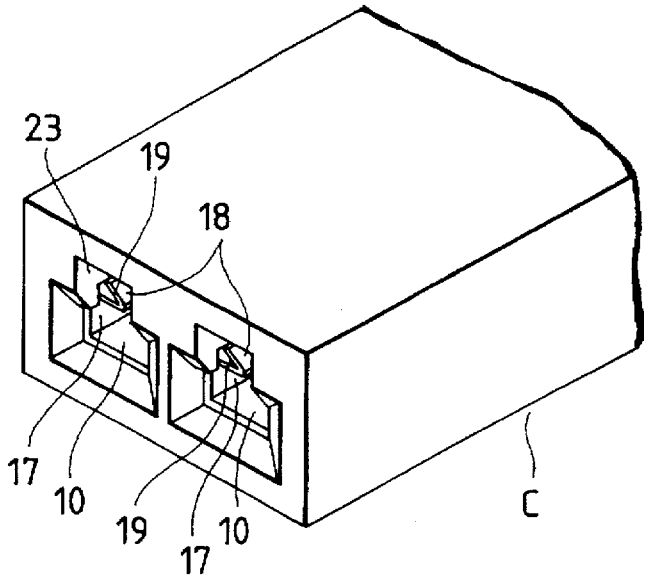
FIG. 3 is a perspective view of an important portion of a connector housing receiving the first embodiment of the female terminal.

In this condition, the front end portion of the guide projection 18 is disposed in an upper portion 23 of the open end of the terminal receiving chamber 10 in the connector housing C (see FIG. 3).

When the connector housing C, receiving the female terminal $A_1$, is fitted into the connector housing D receiving the male terminal B, the tab 15 of the male terminal B is fitted into the fitting portion 4 of the female terminal $A_1$ (see FIG. 11).

If the tab 15 of the male terminal B is in a bent condition, the tab 15 is pressed against the slanting guide surface 19 (as shown in FIG. 11), which projects forwardly beyond the front end surface of the female terminal, of the guide projection 18, and this pressing force produces a component force to urge the tab 15 toward the inlet of the fitting portion 4, so that the tab 15 is brought into sliding contact with the slanting guide surface 19, and is fitted into the fitting portion 4.

If the tab 15 should fail to be brought into sliding contact with the slanting guide surface 19, and is kept stopped while engaged with the slanting guide surface 19, the two connector housings C and D can not be fitted together. Therefore, the incomplete fitting between the two terminals B and $A_1$ can be easily seen from the exterior.

The operation of the second embodiment of the female terminal $A_2$ is similar to that of the first embodiment.

The present invention provides the above construction, and therefore even the male terminal having the bent tab can be fitted into the female terminal with the pushing force used for fitting the two connector housings together.

It will be apparent to those skilled in the art that various modifications and variations can be made to the female terminal for a connector in the present invention without departing from the spirit or scope of the invention. Thus, it is intended that the present invention cover the modifications and variations of this invention provided they come within the scope of the appended claims, drawings, and their equivalents.

What we claim is:

1. A female terminal insertable into a terminal receiving chamber in a connector housing comprising:

an engagement portion for being retainingly held against an elastic engagement arm provided in the terminal receiving chamber;

a base plate portion for being held against that surface of the terminal receiving chamber disposed opposite to that surface of said terminal receiving chamber from which the engagement arm projects;

a wire connection portion formed at a rear end of the female terminal; and a fitting portion formed at a front end of the female terminal, wherein a guide projection is formed on that surface of the fitting portion facing away from the base plate portion, the guide projection projecting forwardly beyond a front end surface of the female terminal, wherein the guide projection includes a guide surface slanting towards an inlet of the fitting portion.

2. A female terminal and a connector housing therefore, wherein the female terminal is insertable into a terminal receiving chamber of the connector housing comprising;

a fitting portion formed at one end of the female terminal having a front end with an inlet;

a guide projection coupled to the front end of the fitting portion;

an engagement portion; and an engagement arm provided in the terminal receiving chamber, wherein a groove is formed in the engagement arm for avoiding an interference of the engagement arm with the guide projection when inserting the female terminal into the terminal receiving chamber.

3. A female terminal and a connector housing therefor according to claim 2, wherein the engagement arm is disposed in the terminal receiving chamber towards the inlet of the fitting portion; and the engagement arm engaging the engagement portion of the fitting portion of the female terminal when the female terminal is inserted into the terminal receiving chamber.

4. A female terminal and a connector housing therefor according to claim 3, wherein the guide projection has a front surface, the front surface providing a slanting guide surface extending from an upper surface of the guide projection to the inlet of the fitting portion.

5. A female terminal and a connector housing therefor according to claim 4, in which the groove formed in the engagement arm is a slot.

6. A female terminal and a connector housing therefor according to claim 4, in which the groove formed in the engagement arm is offset from the center widthwise of the fitting portion.

7. A female terminal and a connector housing therefor according to claim 4, further comprising;

a wire connection portion formed at an opposite end.

8. A female terminal and a connector housing therefor according to claim 7, in which the groove formed in the engagement arm is a slot.

9. A female terminal and a connector housing therefor according to claim 7, in which the groove formed in the engagement arm is offset from the center widthwise of the fitting portion.

10. A connector housing which includes a terminal receiving chamber for receiving a female terminal comprising:

an elastic engagement arm provided in the terminal receiving chamber for cooperation with an engagement portion of the female terminal;

a base portion disposed opposite to a surface of the terminal receiving chamber from which the elastic engagement arm projects; and wherein a groove is formed in the elastic engagement arm for avoiding interference of the engagement arm with a guide projection formed on a fitting portion formed at a front end of the female terminal, the fitting portion facing away from the base plate portion, the guide projection projecting forwardly beyond a front end surface of the female terminal, and the guide projection including a guide surface slanting towards an inlet of the fitting portion.

11. A female terminal according to claim 10, in which the groove formed in the engagement arm is a slot.

12. A female terminal according to claim 10, in which the groove formed in the engagement arm is offset from the center, widthwise of the fitting portion.

* * * * *